United States Patent [19]

Kusz

[11] Patent Number: 4,485,932

[45] Date of Patent: Dec. 4, 1984

[54] CHILD RESISTANT PACKAGE

[75] Inventor: Maximillian Kusz, Waterville, Ohio

[73] Assignee: Owens-Illinois, Inc., Toledo, Ohio

[21] Appl. No.: 512,838

[22] Filed: Jul. 11, 1983

[51] Int. Cl.[3] ..... B65D 55/02

[52] U.S. Cl. ..... 215/222; 215/274; 215/332

[58] Field of Search ..... 215/218, 222, 256, 274, 215/332

[56] References Cited

U.S. PATENT DOCUMENTS

| | | | |
|---|---|---|---|
| 3,510,021 | 5/1970 | Silver | 215/222 |
| 3,608,765 | 9/1971 | Faulstich | 215/256 |

*Primary Examiner*—George T. Hall

*Attorney, Agent, or Firm*—John R. Nelson; Myron E. Click

[57] ABSTRACT

A child resistant package comprising an open-mouth container having a plurality of circumferentially spaced projections extending radially outwardly adjacent the open end thereof, each projection defines a notch facing downwardly, and a closure having a top panel and an annular skirt depending from the periphery of the top panel, and a plurality of radially inwardly extending and circumferentially spaced locking lugs on the inner surface of the skirt. The locking lugs are adapted to engage the notches in the projections on the container. A tamper-indicating member comprises an annular ring having portions extending between the lower edge of the skirt of the closure and a portion of the container and operable to normally limit axial movement of the closure. The ring offers a visual indication that the contents have not been tampered with and the ring must be removed before the closure can be removed. The container includes a specially designed inclined surface provided with dual slopes. One slope extends radially outwardly in a circumferential direction and the other slope extends downwardly and radially inwardly and terminates in a locking notch. The closure can be applied to the container when the tamper-indicating member is in position through rotation of the closure causing the cam lugs on the closure to engage the inclined surface and flex the skirt of the closure outwardly to thereby direct the cam lugs into engagement with the locking notch.

24 Claims, 12 Drawing Figures

CHILD RESISTANT PACKAGE

This invention relates to child resistant packages and particularly to a combined child resistant closure and container.

BACKGROUND AND SUMMARY OF THE INVENTION

It has been recognized that packages for medicinal and other materials should preferably be resistant to removal by children. In one child resistant package shown in U.S. Pat. Nos. 4,059,198 and 4,057,159, the package comprises a cylindrical plastic body which has circumferentially spaced radially extending projections on the upper end thereof which have downwardly facing notches therein. The closure associated with the container comprises a one-piece plastic body having a top panel and a depending annular skirt with circumferentially spaced lugs extending radially inwardly for engagement with the notches. The closure includes a one-piece liner which serves as a spring between the closure and the container to bias the closure lugs into engagement with the projections on the container.

In connection with such closures, an inner seal may be provided over the upper end of the container so that upon removal of the closure, it can be readily ascertained whether the contents have been tampered with. However, the integrity of such a seal cannot be ascertained until the closure is removed.

Accordingly, among the objectives of the present invention are to provide a child resistant package which includes a tamper-indicating device on the closure which provides a visual indication that the contents are intact and which must be removed before the closure can be actuated and removed from the container.

In accordance with the invention, a tamper-indicating ring is provided that has portions that extend between the lower edge of the skirt portion of the closure member and the container to limit axial movement of the closure member. The ring offers a visual indication that the contents have not been tampered with and the ring must be removed before the closure can be removed. The container includes a specially designed inclined surface provided with dual slopes. One slope extends radially outwardly in a circumferential direction and the other slope extends downwardly and radially inwardly and terminates in a locking notch. The closure can be applied to the container when the tamper-indicating member is in position through rotation of the closure causing the cam lugs on the closure to engage the inclined surface and flex the skirt of the closure outwardly to thereby direct the cam lugs into engagement with the locking notch. Preferably, plural cams and notches are provided peripherally about the finish of the container.

DESCRIPTION

Figure 1:
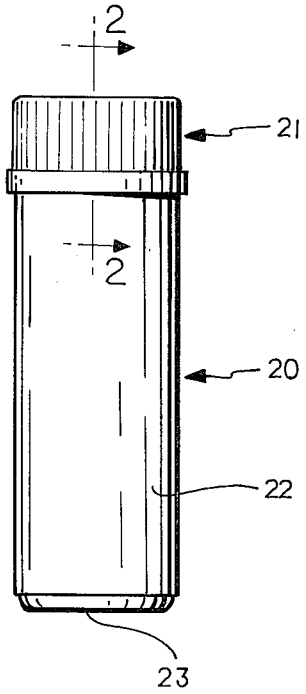
FIG. 1 is an elevational view of a child resistant package embodying the invention.

Referring to FIGS. 1–7, the child resistant package comprising the invention includes a container 20 and a closure 21. The container 20 is shown as being cylindrical and having a side wall 22 and bottom wall 23 with an open upper end defining a rim 24. The container 20 is provided with a plurality of circumferentially spaced, radially extending projections 25 formed on the upper end of the outer surface of the wall 22. The projections 25 include tapered cam surfaces 26 and radial surface 27 and axial surfaces 28, 29 to define a notch 30 that faces downwardly. Cam surface 26 have dual slopes. One slope extends radially outwardly in a circumferential direction and the other slope extends downwardly and radially inwardly and terminates at the locking notch 30.

Figure 2:
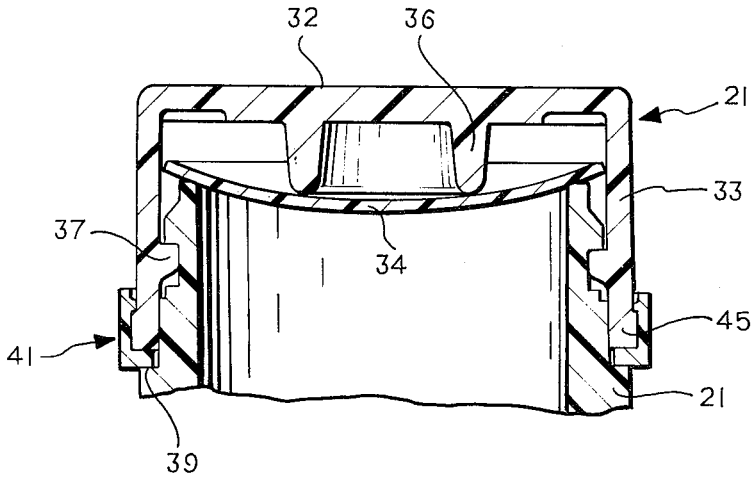
FIG. 2 is a fragmentary vertical sectional view on an enlarged scale of the child resistant package.
Figure 7:
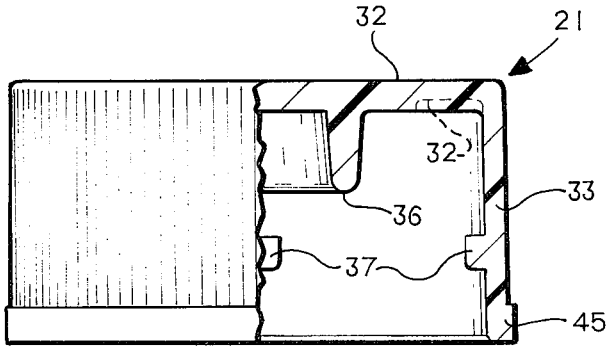
FIG. 7 is a fragmentary sectional view on an enlarged scale taken along the line 7—7 in FIG. 6.
Figure 8:
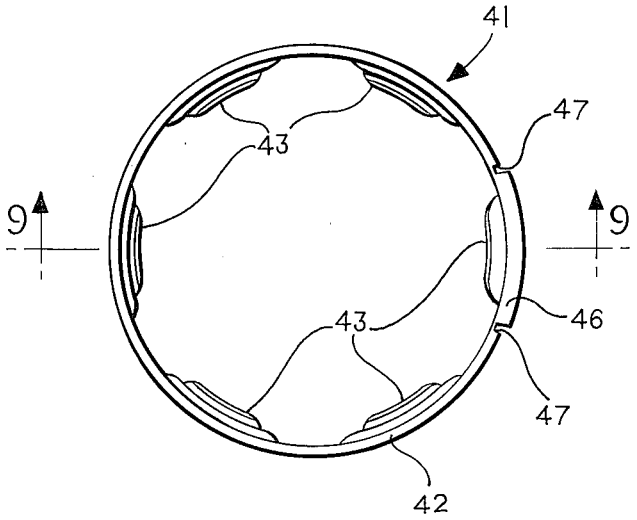
FIG. 8 is a top plan view of the tamper-indicating band.
Figure 9:
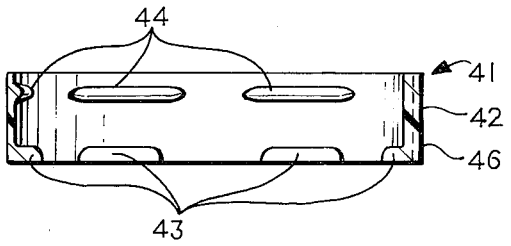
FIG. 9 is a fragmentary sectional view on an enlarged scale taken along the line 9—9 in FIG. 8.
Figure 10:
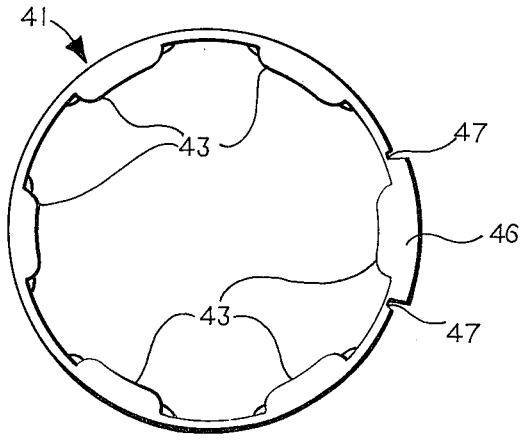
FIG. 10 is a bottom plan view of the tamper-indicating band.

Referring to FIGS. 7 and 8, the closure 21 includes a top panel 32 and an annular peripheral wall or skirt 33. As shown in FIG. 2, a liner in the form of a disk 34 of plastic such as polyethylene is interposed between the closure and the container to seal the end of the container.

Disk 34 also provides a spring urging the central portion of disk 34 against an annular rib 36 on the closure 21. The container and closure are described in U.S. Pat. No. 4,057,159 which is incorporated herein by reference.

The closure 21 is also formed with a plurality of inwardly extending rectangular locking lugs 37 circumferentially spaced about the inner surface of the wall 32 and adapted to engage the notches 30 on the projections 25 on the container as presently described. The container and closure are preferably made of organic plastic material.

In normal operation, in order to engage the closure 21 with the container 20, the closure 21 is brought into position adjacent the upper end of the container so that the locking lugs 37 are between the projections 25. The closure 21 is then rotated so that the locking lugs 37 slide along the inclined or camming surfaces 26 of the projections 25 and move axially downwardly until the locking lugs 36 snap up and engage the notches 30.

In order to remove the closure 21 from the container 20, an axial downward force is applied to the closure 21 against the spring action and the closure 21 is rotated in the opposite direction to disengage the locking lugs 37 from the projections 25.

Figure 3:
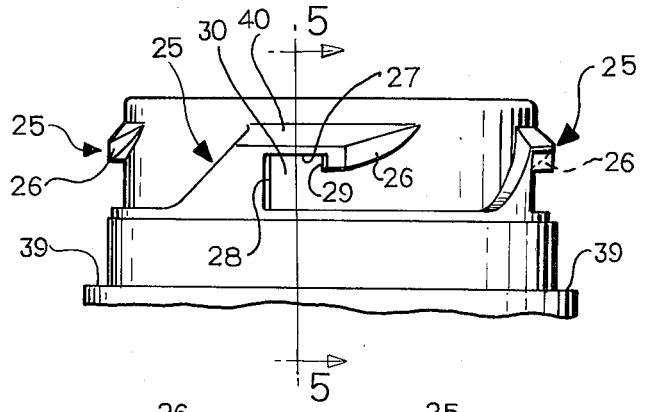
FIG. 3 is a fragmentary part sectional elevational view of the container forming part of the child resistant package.
Figure 4:
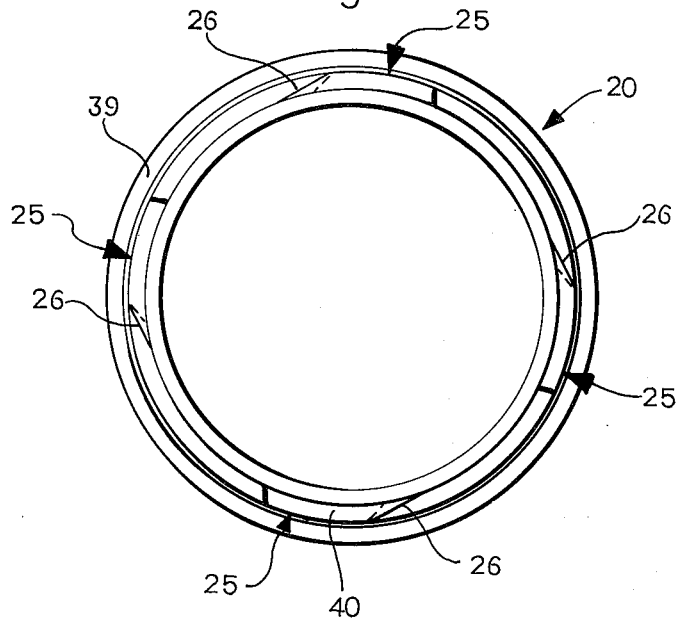
FIG. 4 is a plan view on an enlarged scale of the container.
Figure 5:
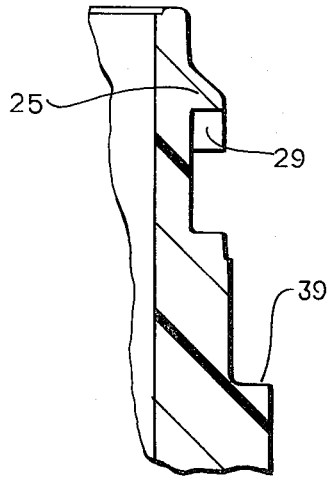
FIG. 5 is a fragmentary sectional view taken along the line 5—5 in FIG. 4.
Figure 6:
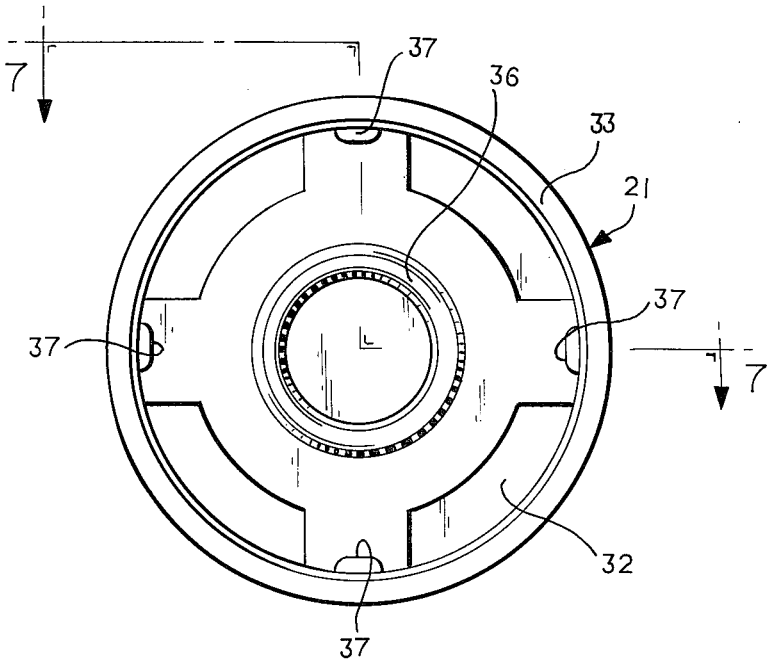
FIG. 6 is a bottom plan view of the closure.

Referring to FIGS. 3–5, the container 20 is provided with an annular shoulder 39 beneath the projections 25. In addition, each projection 25 is provided with an upper surface 40 that tapers downwardly and radially outwardly.

Referring to FIGS. 1 and 2, a tamper-indicating member 41, preferably made of plastic such as high density polyethylene, is provided about the lower end of the closure and comprises an annular wall 42 and a plurality of projections 43 extending radially inwardly from the inner surface of the wall 42 between the lower end of the skirt portion 33 of the closure 21 and shoulder 39 on the container 20. Shoulder 39 is positioned such that there is sufficient space between the lower end of the skirt 33 and the shoulder 39 for the projections 43.

Tamper-indicating ring 41 includes circumferentially spaced arcuate beads 44 on the inner surface of the wall 42 that snaps over a small flange 45 on the skirt 33 of the closure 21 to retain the ring 41 on the closure during handling and application to the container 20. The vertical distance between beads 44 and the projections 43 is substantially equal to the height of the flange 45 so that the ring 41 is held tightly on the closure. After a container 20 has been filled, the closure 21 with the tamper-indicating ring 41 thereon is applied to the container 20. However, the closure 21 cannot be applied in the conventional fashion due to the presence of the ring 41. Accordingly, the closure 21 is applied by rotation in a clockwise direction relative to the container whereby the lugs 37 engage and slide circumferentially on the cam surfaces 26 flexing the skirt 33 of the closure outwardly until the lugs 37 snap past the surface 29 and into notches 30.

With the closure 21 and tamper-indicating ring 41 in position, the projections 43 extend between the skirt 33 of the closure 21 and the shoulder 39 on the container 20 and normally limit axial movement of the closure. Any effort to move the closure 21 axially to disengage the lugs 37 is prevented by the projections 43. Accordingly, the tamper-indicating ring 41 provides a visual indication that the package has not been tampered with.

In order to remove the closure, the tamper-indicating ring 41 must first be removed. To facilitate this, a thickened portion 46 is provided which is grasped to tear the band. To further facilitate the tearing, axial grooves 47 on the band define weakened lines.

It can thus be seen that there has been provided a tamper-indicating device which will effectively prevent opening of the package and must first be removed. The presence of the tamper-indicating device provides visual indication that the child resistant package has not been tampered with.

Although the invention has been described in connection with a child resistant package wherein the spring means which urges the closure upwardly relative to the container is provided by a fitment, the invention can be applied to child resistant packages of the type shown in U.S. Pat. No. 3,344,942 wherein the closure is yieldingly urged away from the container to hold the lugs in engagement with the notches by an integral spring forming part of the closure. Such a construction is incorporated herein by reference. This invention is also applicable to a child resistant package which includes a fitment having a sealing portion engaging the rim of the container, a plug portion engaging the inner surface of the shoulder of the container and providing a spring yieldingly urging the closure away from the container as shown in U.S. Pat. No. 4,059,198 which is incorporated herein by reference.

Figure 11:
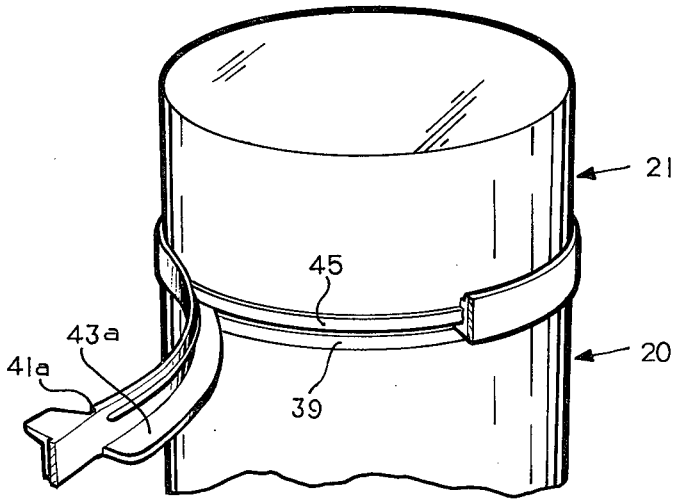
FIG. 11 is a perspective view of a modified form of child resistant package during opening of the package.

In the form of the invention shown in FIG. 11, the portion of the tamper-indicating band **41*a* which projects between the closure and the shoulder 39 on the container comprises a continuous annular ring 43*a*** extending radially inwardly.

Figure 12:
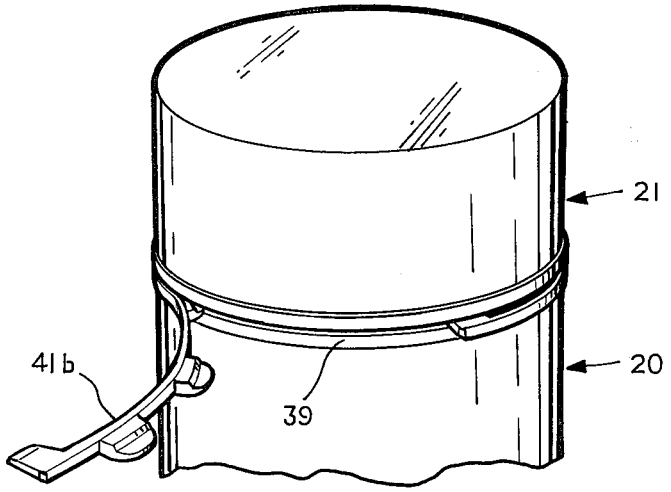
FIG. 12 is a perspective view of another modified form of child resistant package during opening of the package.

In the form of the invention shown in FIG. 12, the tamper-indicating member **41*b*** is formed without an annular wall. This form of tamper-indicating member must be placed on the container before the closure is applied to the container.

I claim:

1. A child resistant package comprising an open-mouth container having a body with a circumferentially spaced projection extending radially outwardly adjacent the open end thereof, said projection having a downwardly facing locking notch, a closure having a top panel and an annular skirt depending from the periphery of the top panel, a plurality of radially inwardly extending and circumferentially spaced locking lugs on the inner surface of said skirt, said locking lugs being adapted to engage the shoulder in the projection on the container, means yieldingly urging the closure upwardly to cause a lug to remain in engagement with said notch when the closure is on the container, a tamper-indicating member comprising an annular ring having portions extending between the lower edge of the skirt of the closure and a portion of the container and operable to normally limit axial movement of the closure, said container including a surface extending from the body of the container to a position adjacent the notch and being downwardly and outwardly inclined such that the closure can be applied to the container when the tamper-indicating member is in position through rotation of the closure causing a cam lug on the closure to engage and move on the inclined surface and flex the skirt of the closure outwardly to thereby direct the cam lug into engagement with the locking notch.

2. The child resistant package set forth in claim 1 wherein said tamper-indicating member is mounted on said container.

3. The child resistant package set forth in claim 1 wherein said tamper-indicating member is mounted on the closure.

4. The child resistant package set forth in claim 1 wherein said ring of said tamper-indicating member surrounds said skirt portion of said closure.

5. The child resistant package set forth in claim 4 wherein said radially extending portions extend from the lower edge of said ring.

6. The child resistant package set forth in claim 5 wherein said radial portions are circumferentially spaced.

7. The child resistant package set forth in claim 6 wherein said radial portions are equally spaced.

8. The child resistant package set forth in claim 1 wherein said ring includes an annular bead, said skirt of said closure including an annular rib for retaining said ring on said skirt.

9. The child resistant package set forth in claim 8 wherein the lower end of the skirt of the closure normally engages the radial portions of said ring when said ring is in position on said closure.

10. The child resistant package set forth in claim 1 wherein said tamper-indicating ring includes a weakened line to facilitate removal.

11. The child resistant package set forth in claim 10 wherein said tamper-indicating ring includes a thickened portion for grasping the ring to facilitate removal.

12. The child resistant package set forth in claim 11 wherein said thickened portion extends radially.

13. The child resistant package set forth in claim 1 wherein said portions extending from said tamper-indicating member comprise a solid ring portion extending between the lower edge of the skirt of the closure and a portion of the container and operable to normally prevent axial movement of the closure.

14. The child resistant package set forth in claim 1 wherein said tamper-indicating member comprises a ring underlying said skirt portion of said outer closure.

15. The child resistant package set forth in claim 1 wherein said inclined surface on said container has a dual slope, one said slope extending radially outwardly in a circumferential direction and the other slope extending downwardly and radially inwardly.

16. For use in a child resistant package, an open-mouth container having a body with a circumferentially spaced projection extending radially outwardly adjacent the open end thereof, said projection defining a downwardly facing locking notch, a tamper-indicating member adapted to be positioned on the container and comprising an annular ring having portions extending between the lower edge of a skirt of of a closure when applied to the container and a portion of the container to normally limit axial movement of the closure, said container including a surface extending from the body of the container to a position adjacent the notch and being downwardly and outwardly inclined such that a closure can be applied to the container when the tamper-indicating member is in position through rotation of the closure causing a cam lug on the closure to engage the inclined surface and flex the skirt of the closure outwardly to thereby direct a cam lug into engagement with the locking notch.

17. The container set forth in claim 16 wherein said inclined surface on said container has a dual slope, one said slope extending radially outwardly in a circumferential direction and the other slope extending downwardly and radially inwardly.

18. The container set forth in claim 16 including a tamper-indicating member comprising an annular ring having portions extending between the lower edge of the skirt of a closure and a portion of the container and operable to normally prevent axial movement of the closure.

19. A child resistant package comprising a container, a closure having a peripheral skirt, interengaging means between said closure and said container operable upon relative axial movement between said closure and container to engage and disengage said closure and container, and a separate tamper-indicating member adapted to be positioned on the container comprising an annular ring having portions extending between the lower edge of the skirt portion of said closure and a portion of the container and operable to normally limit axial movement of the closure.

20. The child resistant package set forth in claim 19 wherein said tamper-indicating ring includes a weakened line to facilitate removal.

21. The child resistant package set forth in claim 20 wherein said tamper-indicating ring includes a thickened portion for grasping the ring to facilitate removal.

22. The child resistant package set forth in claim 21 wherein said thickened portion extends radially.

23. The child resistant package set forth in claim 1 wherein said container has a plurality of circumferentially spaced projections extending raidally outwardly adjacent the open end thereof, each said projection having a downwardly facing locking notch.

24. The container set forth in claim 16 wherein said container has a plurality of circumferentially spaced projections extending radially outwardly adjacent the open end thereof, each said projection having a downwardly facing locking notch.

* * * * *